United States Patent [19]

Cooley

[11] Patent Number: 4,481,750

[45] Date of Patent: Nov. 13, 1984

[54] PACKAGING APPARATUS AND METHOD

[75] Inventor: Jack S. Cooley, Atlanta, Ga.

[73] Assignee: The Mead Corporation, Dayton, Ohio

[21] Appl. No.: 318,828

[22] Filed: Nov. 6, 1981

[51] Int. Cl.[3] ..... B65B 21/24

[52] U.S. Cl. ..... 53/398; 53/48

[58] Field of Search ..... 53/398, 48, 209, 556

[56] References Cited

U.S. PATENT DOCUMENTS

| | | | |
|---|---|---|---|
| 3,045,401 | 7/1962 | Ganz | 53/48 |
| 3,410,397 | 11/1968 | Cato | 53/398 X |
| 3,430,413 | 3/1969 | Wood | 53/48 |
| 3,456,420 | 7/1969 | Ganz | 53/209 X |
| 3,541,757 | 11/1970 | Bertrand | 53/398 X |
| 3,557,521 | 1/1971 | Pierce | 53/398 |
| 3,572,003 | 3/1971 | Perry | 53/398 |
| 4,144,697 | 3/1979 | Suga | 53/556 |
| 4,237,673 | 12/1980 | Calvert | 53/48 |
| 4,285,185 | 8/1981 | Collura | 53/48 |
| 4,338,760 | 7/1982 | Kuhn | 53/48 |

*Primary Examiner*—John Sipos

*Attorney, Agent, or Firm*—Rodgers & Rodgers

[57] ABSTRACT

A packaging machine includes moveable spaced metering bars and guide means for supplying groups of articles from an infeed conveyor to a packaging station and is arranged to tighten a carrier blank about a group of articles while the blank and articles are moved by the metering bars and includes tightening means movable along the group of articles on each side thereof and which engage portions of the blank on each side of the group near the bottom portions of the articles by means which moves at substantially the same velocity as the velocity of movement of the group of articles and blank and which imparts a downward tightening force thereto without causing any substantial frictional dragback and which need not move in precisely timed sequence with a blank and an associated group of articles.

13 Claims, 14 Drawing Figures

PACKAGING APPARATUS AND METHOD

TECHNICAL FIELD

This invention relates to the packaging of a plurality of articles in a carrier blank of the wrap around type and is concerned primarily with tightening of the blank as a prerequisite to securement of the end edges of the blank in overlapping relationship underneath a group of articles.

BACKGROUND ART

U.S. Pat. No. 3,456,420 issued July 22, 1969 discloses an arrangement in which a wrapper type blank is tightened about a group of articles by means of a fixed bar which is arranged to engage portions of a wrapper and to impart a tightening action thereto as a group of articles and the associated wrapper are moved along a predetermined path. One objection to this type of tightening mechanism centers around the fact that a substantial frictional force is imparted to the wrapper as it moves along due to frictional contact between the wrapper and the static tightening bar.

U.S. Pat. No. 4,285,185 issued Aug. 25, 1981 discloses apparatus for tightening a wrapper blank about a group of articles and for positioning the articles relative to the blank. This arrangement constitutes pivotally mounted elements arranged to move alongside an article group and its associated wrapper and the movement thereof is timed so that the pivotally mounted elements are arranged to enter apertures in the side walls of the wrapper. An objection to this arrangement resides in the fact that precise timing of the movement of the pivotally mounted tightening elements relative to the movement of the article group and associated wrapper is required. Of course if timing becomes insufficiently precise due to wear or for any other reason, costly shut downs and package damage may result. This arrangement provides means for pulling the wrapper downwardly only.

U.S. Pat. No. 4,237,673 issued Dec. 9, 1980 and owned by the assignee of this invention discloses an arrangement in which a plurality of movable metering bars are arranged to cooperate with angularly disposed guide means in such a manner as to meter a group of primary packages into the open ends of a sleeve type wrapper disposed between the metering bars and movable therewith. This arrangement provides an efficient means of loading an open-ended wrapper from both ends but is not well suited for use in conjunction with wraparound type packages.

DISCLOSURE OF INVENTION

In accordance with this invention in one form, the tendency of fixed tightening bars to effect frictional drag back on the side panels of a wraparound type carrier is avoided and tightening is effected by movable tightening apparatus the movement of which need not be precisely positioned with respect to the movement of a group of articles and its associated wrapper and includes a series of lugs mounted on endless elements on each side of a group of articles and of their associated wrapper and in which each lug is constructed with a tightening edge aligned with the tightening edges of the remaining lugs so as to provide a substantially continuous tightening edge movable through a tightening station in the general direction of the articles and blanks but in a downwardly and inwardly divergent direction so as to engage openings and associated tabs projecting thereinto which are formed in the portion of the blank adjacent the lower parts of the articles to be packaged so as to impart a tightening force to the wrapper. According to one feature of the invention, articles to be packaged are metered and arranged in groups to be packaged by a series of metering bars mounted at corresponding ends on one side of the path of movement of the articles being packaged and the metering action is effected by the free ends of the metering bars which cooperate with angularly related guide means so as to establish a group of articles to which a wrapper is then applied.

BEST MODE OF CARRYING OUT THE INVENTION

Figure 1:
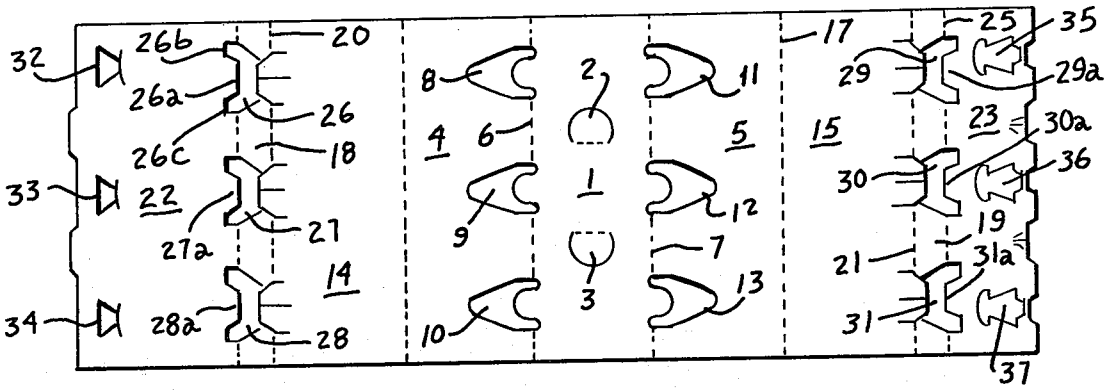
FIG. 1 is a plan view of a blank of the type to which this invention applies.
Figure 2:
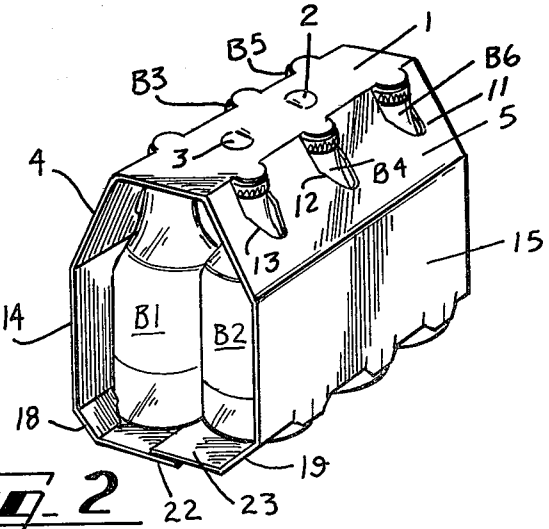
FIG. 2 is a perspective view of a completed package comprising a plurality of primary packages such as bottles which are packaged within the wrapper blank of FIG. 1.

A wrapper type blank such as is shown in FIG. 1 for forming the package shown in FIG. 2 includes a top panel 1 having finger gripping apertures 2 and 3 formed therein. Sloping shoulder panels 4 and 5 are foldably joined to top wall 1 along fold lines 6 and 7 respectively. Apertures 7–13 are of known construction and for the purpose of receiving the upper portions of packaged bottles as indicated in FIG. 2. Side wall panels 14 and 15 are foldably joined to sloping shoulder panels 4 and 5 respectively along fold lines 16 and 17. Angularly disposed panels 18 and 19 are foldably joined to side walls 14 and 15 respectively along fold lines 20 and 21 and bottom lap panels 22 and 23 are foldably joined to angularly disposed panels 18 and 19 along fold lines 24 and 25 respectively. Apertures 26-31 inclusive are formed in the lower portions of side walls 14 and 15 as well as in the sloping panels 18 and 19 and adjacent portions of the bottom lap panels 22 and 23 as is evident in FIG. 1.

For the purpose of securing lap panels 22 and 23 together in overlapping relationship, a plurality of locking apertures 32, 33, and 34 are formed in lap panel 22 and a plurality of locking tabs 35, 36 and 37 are formed in lap panel 23 and are arranged to cooperate in known manner with locking apertures 32, 33 and 34 respectively.

Figure 3:
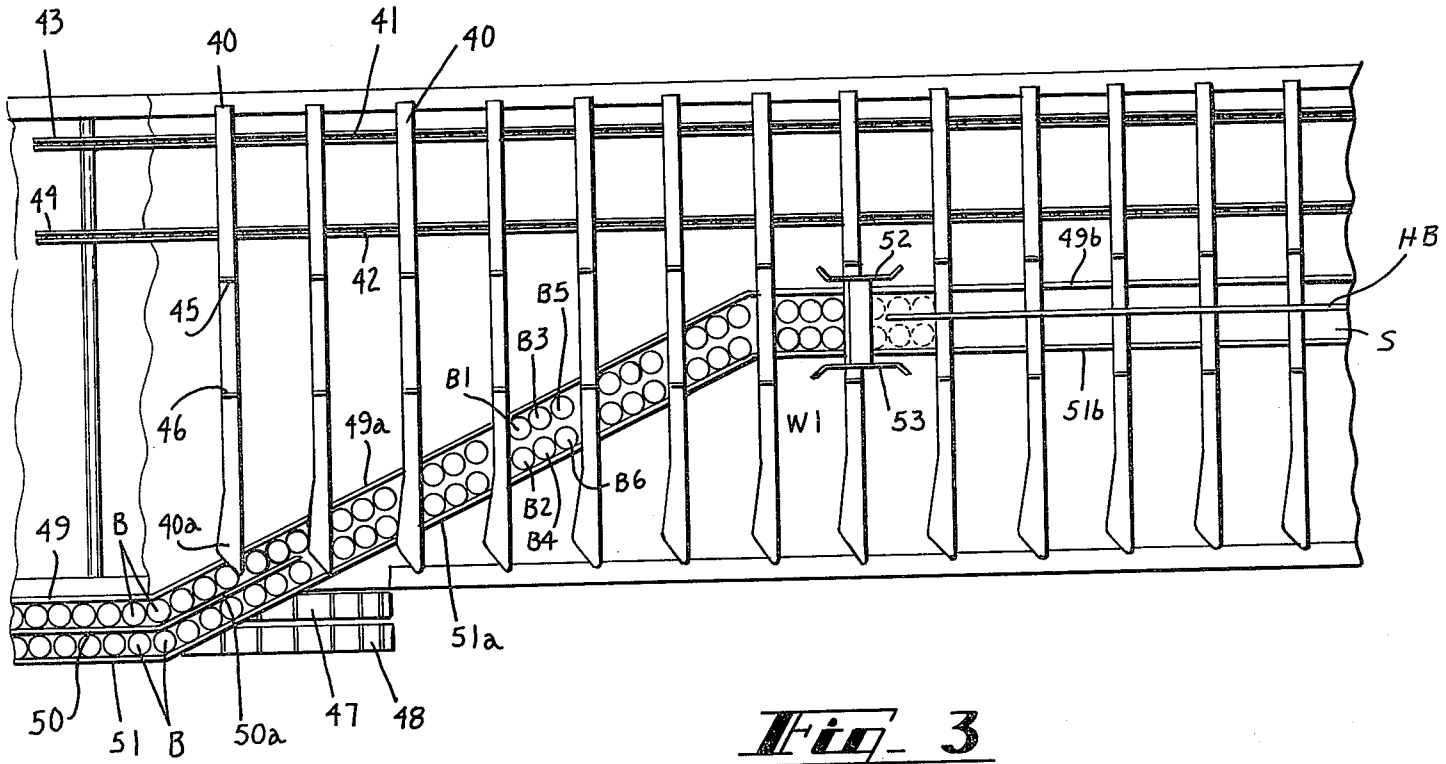
FIG. 3 is a plan view from above of a portion of a packaging machine which embodies this invention.
Figure 4A:
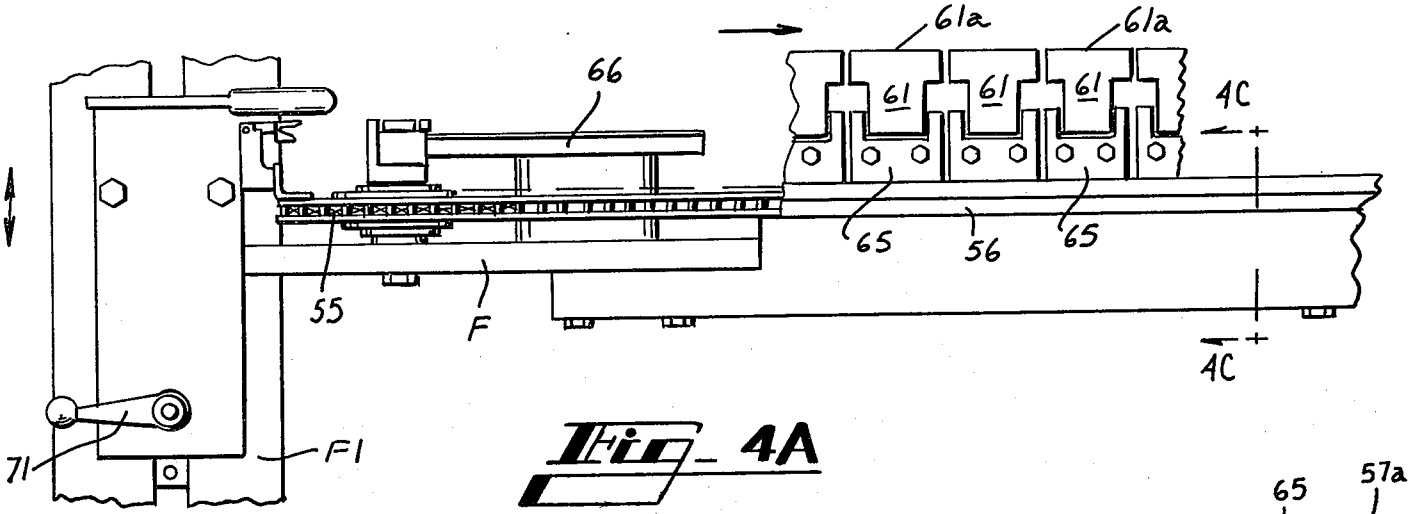
FIG. 4A is a fragmentary plan view from above of a portion of a machine according to this invention.
Figure 4B:
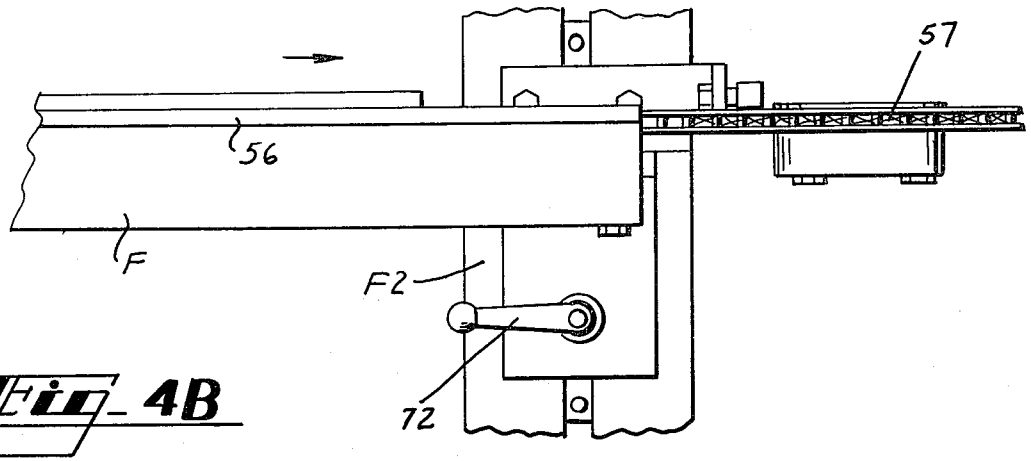
FIG. 4B is a continuation of FIG. 4A.

A packaging machine formed according to one aspect of this invention is represented in FIG. 3 and includes a plurality of metering bars 40 each of which is secured at one end to a pair of parallel chains designated by the numerals 41 and 42. Chain 41 cooperates with idler sprocket 43 and is driven by a driving sprocket at the right hand end thereof as viewed in FIG. 2 but which is not shown but which is of conventional construction. Similarly chain 42 cooperates with sprocket 44 and is driven by a conventional driving sprocket 44*a* at the right hand portion of FIG. 6B. Secured to each metering bar 40 are a pair of vertically disposed rods 45 and 46 which receive carton blanks such as are shown in FIG. 1 and which are arranged in transverse relation to the mechanism and which are interposed between the upright rods 45 and 46 of adjacent metering bars which serve to receive these blanks from a hopper not shown and which maintain the blank in proper position as they are fed to the packaging station which appears at the right hand portion of FIG. 3 and which includes structure such as is shown in FIGS. 4A and 6A.

For the purpose of feeding primary packages such as bottles into the packaging machine an infeed conveyor having portions 47 and 48 is arranged to supply the articles designated B which are arranged in two rows between infeed guides 49, 50 and 51.

As is apparent from FIG. 3 guide 49 has an angularly disposed portion 49*a* while guides 50 and 51 include angularly disposed portions 50*a* and 51*a*. Thus with the bottles B in close contact with each other as shown in FIG. 3, and with the metering bars 40 moving toward the right as viewed in FIG. 3 the wedge shaped end portions such as 40*a* enter the line of articles and separate those articles into groups such for example as are designated in FIG. 3 at B1–B6 inclusive. Guide 49*a* changed direction as shown in FIG. 3 to guide the bottles B along a predetermined path as indicated at 49*b*. Similarly guide 51*b* is generally parallel with guide 49*b* as indicated in FIG. 3.

Figure 6A:
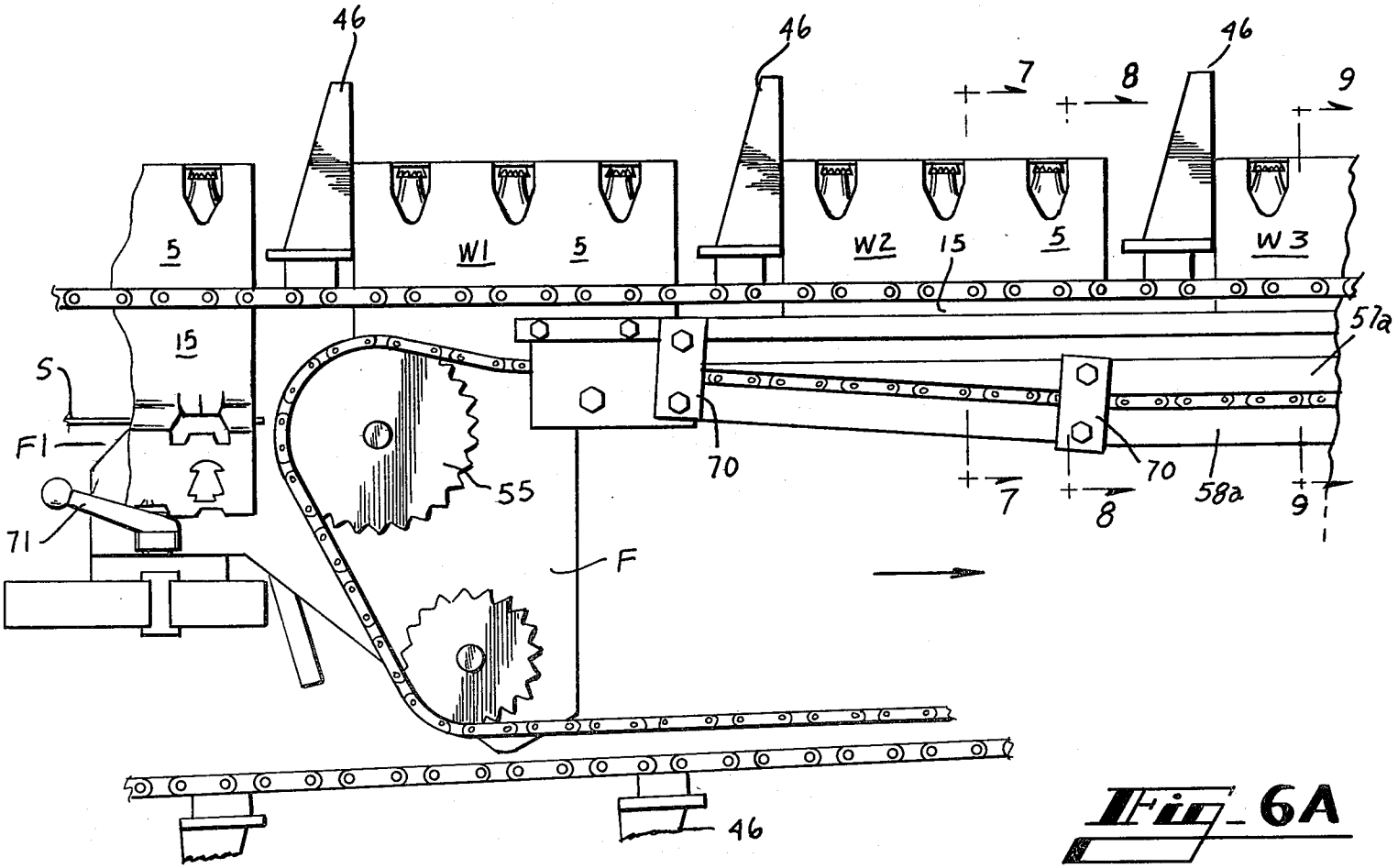
FIG. 6A is a side view which corresponds generally to FIG. 4A.

Blanks such as that represented in FIG. 1 are fed into the apparatus shown in FIG. 3 from a hopper located above the apparatus of FIG. 3 and toward the left and are moved toward the right by the vertical rods 45 and 46 so that when a wrapper arrives at the position designated W1 in FIG. 6A and as indicated by the designation W1 in FIG. 3, the wrapper is in horizontal form as shown in FIG. 1. Immediately thereafter rotatable folding elements schematically represented at 52 and 53 in FIG. 3 are provided with folding arms which engage the side walls 14 and 15 and fold those side walls along with the bottom lap panels, the sloping shoulder panels, and the angularly disposed panels into downwardly extending positions as indicated at W1 in FIG. 6A.

The article group such as that designated at W1 in FIG. 6A and its blank are moved to the position designated W2 in FIG. 6A by means of the associated metering bar 40. When disposed at position W2, the article group and its associated wrapper are prepared for the beginning of a wrapper tightening operation in accordance with one principal aspect of this invention.

Figure 4C:
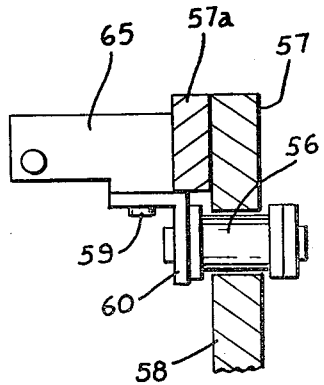
FIG. 4C is a cross sectional view taken along the line designated 4c in FIG. 4A.

This tightening action is effected by a series of tightening lugs pivotally mounted on an endless chain disposed on each side of the article group and the tightening edge of each lug is arranged with respect to the tightening edge of the adjacent lug so as to form a substantially continuous tightening edge which moves in substantial unison with the cartons and the associated groups of articles. As is apparent in FIGS. 4A and 6A, a sprocket 55 supported in any suitable manner on frame structure F cooperates with an endless chain 56 which is driven by driving sprocket 55*a* shown at the right hand portion of FIG. 6B. As is shown in FIG. 4C, chain 56 is guided by a pair of vertically spaced chain track elements 57 and 58 and tightening lugs L are secured by bolts 59 and brackets 60 to chain 56. A wear strip 57*a* is secured to chain guide 57.

Figure 7B:
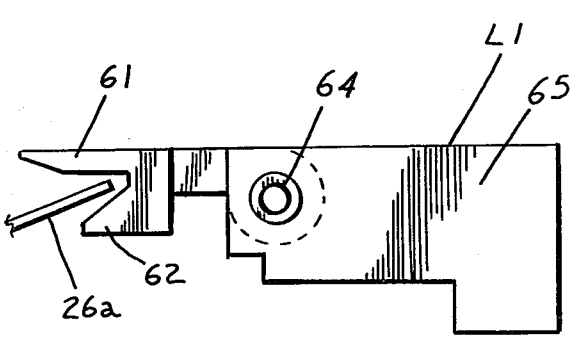
FIG. 7B is a side view of a tightening lug formed according to one aspect of this invention.
Figure 7A:
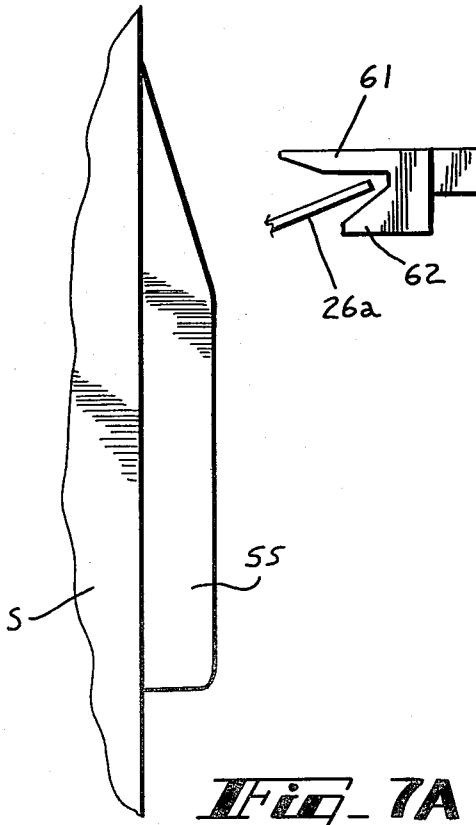
FIG. 7A is a plan view of one element of FIG. 7.
Figure 9:
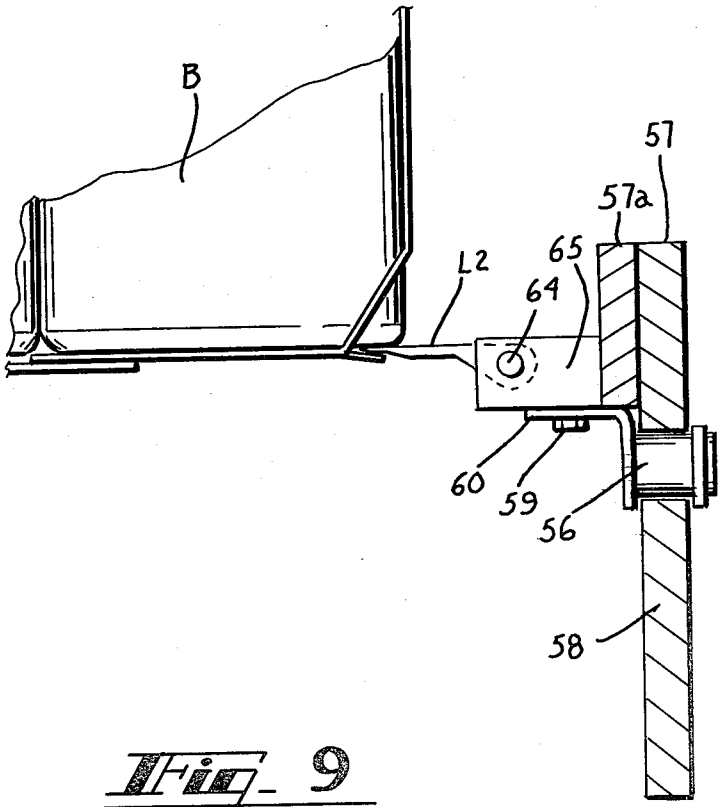
FIG. 9 is an enlarged fragmentary cross sectional view taken along the line designated 9—9 in FIG. 6A.
Figure 8:
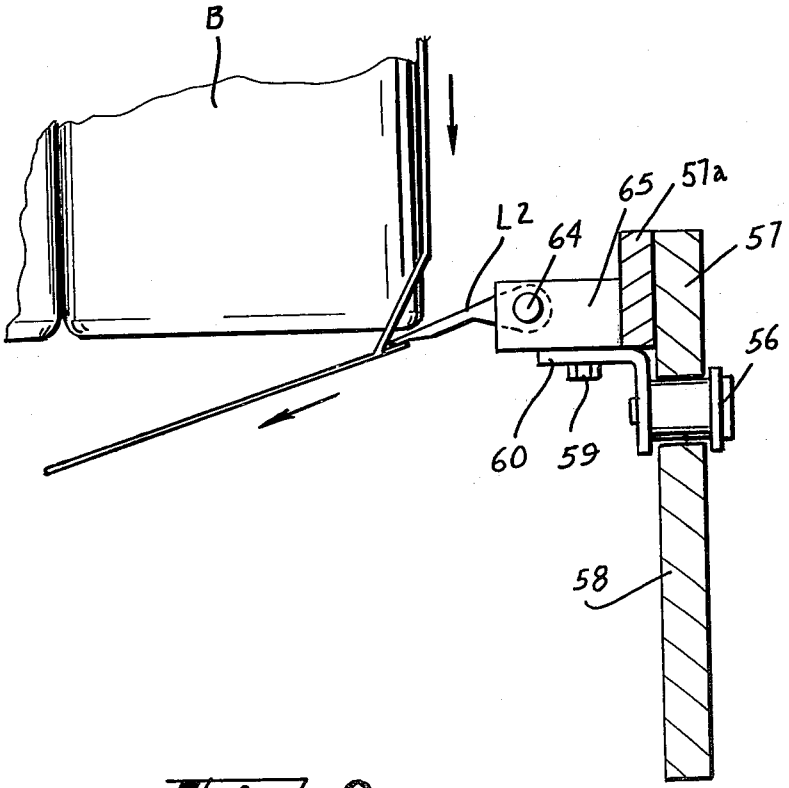
FIG. 8 is an enlarged fragmentary cross sectional view taken along the line designated 8—8 in FIG. 6A

Tightening lugs L may be formed of two principal parts as indicated in FIGS. 7A, 8 and 9. The lugs L1 may have a single pair of prongs 61 and 62 as shown in FIG. 7B or may include a single prong such as is indicated at 63 in FIGS. 8 and 9. The elements such as 61 and 62 and 63 are pivoted at 64 to base portion 65 secured by bolts 59 to brackets 60. Base portion 65 slides along wear strip 57*a*.

Figure 5:
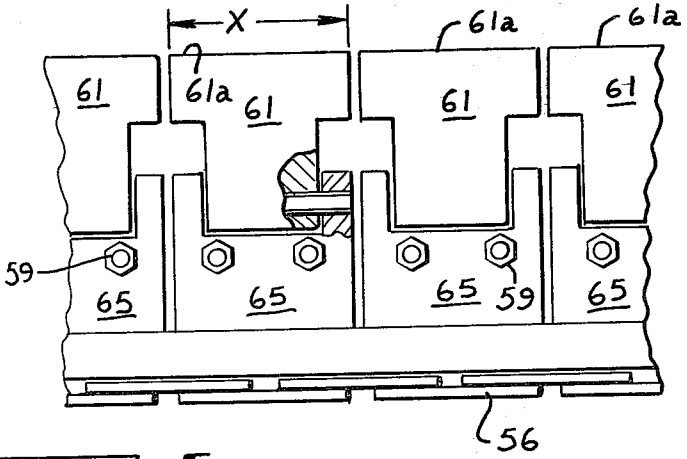
FIG. 5 is an enlarged view similar to a portion of FIG. 4A.

Since the pair of bifurcated prongs 61 and 62 of lug L1 or portion 63 of lug L2 are pivotally mounted to the base portion 65 of the lug, it is necessary to position the prong portion properly to engage the carton apertures such as 26–31. Toward this end, a cam 66 as best shown in FIG. 4A is fixed in position and is arranged to engage the lugs and to position these lugs in the proper position for entering apertures 26–31 and in the case of prongs 61 and 62 to cause tabs such as 26*a*–31*a* to move into the space between the prongs 61 and 62. It is apparent from FIG. 7B that prong 61 is the longer upper prong and that it normally overlies the tabs 26*a*–31*a* and that the free edges of these tabs are received between prongs 61 and 62. The prongs such as 61 or the prongs such as 63 enter the apertures such as 26–31. Since the chain 56 is moving from left to right as viewed in FIGS. 4A and 6A, and since this chain 56 is moving at approximately the same speed as the metering bars 40, there is substantially no frictional drag back between the tightening lugs and the wrapper such as that indicated at W2. Furthermore as is apparent from FIGS. 4A and 5, the tightening edge 61*a* of each tightening lug such as 61 together with the other tightening edges form a substantially uninterrupted composite tightening edge. Thus it is immaterial according to one advantageous feature of the invention exactly where a particular lug is arranged relative to a particular aperture such as 26–31. Preferably the tightening edge such as 61*a* is arranged to engage portion 26*b* and 26*c* of the aperture 26, such portion being located on parts of the aperture which are disposed on opposite sides of tab 26*a* which as is apparent from FIG. 1 is formed integrally with lap panel 22 and which projects into opening 26. Of course all of the tabs 26*a*–31*a* cooperate with all of the openings and tabs in the manner described in connection with opening 26 and tab 26*a*.

Should a lug such as 61 having a transverse edge dimension X from one side to the opposite side which is less than the transverse dimension of any one of the apertures such as 26–31, it would be possible for that lug simply to enter the aperture without imparting tightening force thereto. This situation is accommodated by the fact that the prongs 61 and 62 as shown in FIG. 7B are provided. Thus a tab such as 26*a* is captured between the prongs 61 and 62 and tightening force is imparted to that tab even though the associated lug may be small enough to enter the aperture such as 26.

Should the situation prevail wherein the width X of lugs 61 is greater than the transverse dimension of apertures 26–31, it would not be necessary to use the two prong lug as shown in FIG. 7B and the single prong lugs such as are indicated at 63 in FIGS. 8 and 9 could be employed. Also the single prong lug is adequate where the distance between tabs of adjacent apertures is less than the lug width even though aperture length is greater than lug width.

Figure 6B:
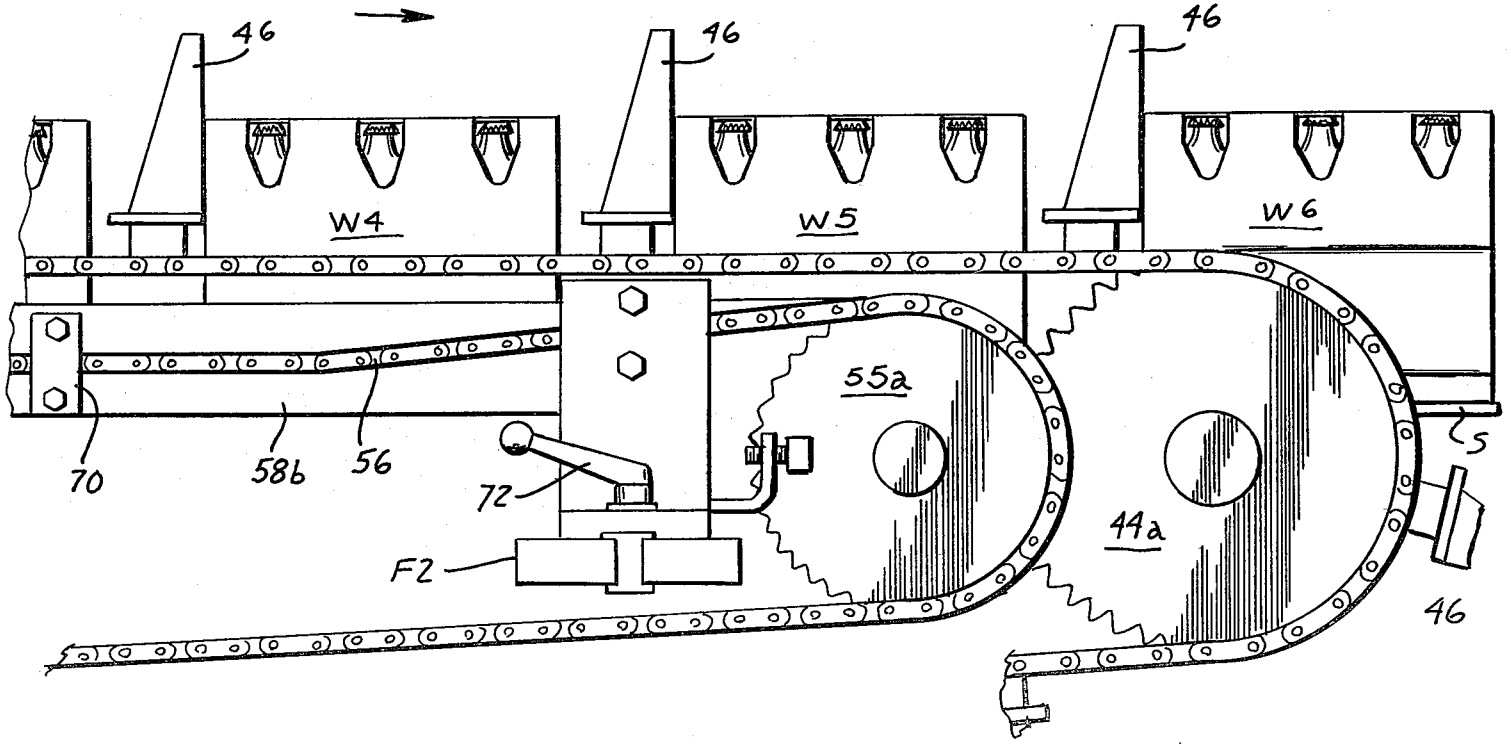
FIG. 6B is a side view corresponding generally to FIG. 4B.

Once lugs have entered the apertures on each side of the carton such as apertures 26–31, tightening downward force is imparted thereto because of the downward motion of the chain 56. As is apparent in FIG. 6A and FIG. 6B, chain guides 57 and 58 for chains 56 are supported by brackets 70 which are secured to the frame F of the machine. Thus as chain 56 is driven by driving sprocket 55*a* best shown in FIG. 6B to cause its upper or working reach to move from left to right, downward motion is imparted to the lugs 61 as best shown in FIG. 6A wherein it is apparent that the mid-portions 57*a* and 58*a* of chain guides 57 and 58 are disposed downwardly relative to the left hand end of the chain guides. This downward inclination of the chain 56 imparts downward motion to the lugs L and in turn imparts a tightening downward and inward motion to both sides of each wrapper. Once a wrapper is sufficiently tightened for example at the position designated W3, suitable known mechanism not shown in the drawings and which does not constitute a feature of this invention simply interlocks the lap panels 22 and 23 in overlapping relation to complete the package into the condition shown in FIG. 2. Once tightening is complete, the chain 56 is guided upwardly by the chain guides which are inclined upwardly as indicated in FIG. 6B at 57*b* and 58*b*. Of course the movement of chain 56 is continuous and the packaging operation is thus continuous. Hold down bar HB overlies the metering bars and insures that the blanks do not ride up and out of proper position.

For the purpose of rendering this machine adaptable for use in conjunction with primary packages such as bottles which are of varying size, the mechanism is laterally adjustable by known means such as is indicated by the adjustable crank 71 which is simply a frictional tightening device which allows portions such as F1 of the supporting frame to be adjusted transversely of the path of movement of the carton and bottles. A tightening element 72 must be used at the outfeed end of the mechanism. Such mechanism is mounted on fixed frame structure F2.

The bottles are supported throughout their movement on a sword S on which the bottles are slidable, the sword S being fixed in position.

Figure 7:
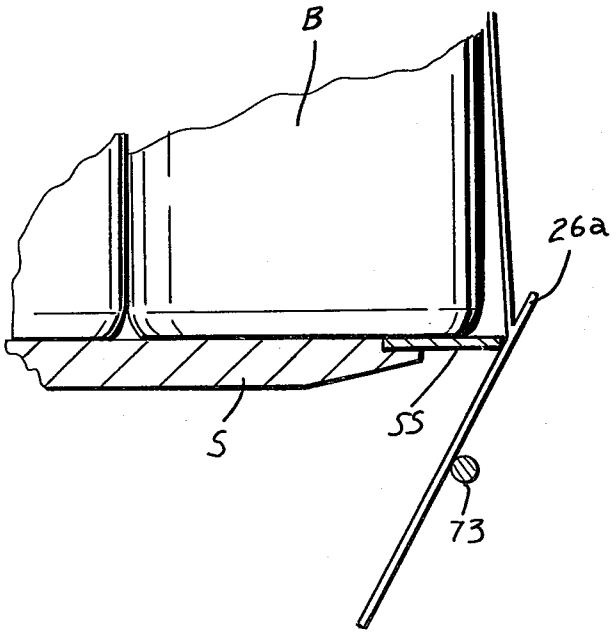
FIG. 7 is an enlarged fragmentary cross sectional view taken along the line designated 7—7 in FIG. 6A.

In order to initiate a tightening operation, the lap panels 22 and 23 are swung inwardly somewhat by a plow 73 to occupy a position such as that indicated at FIG. 7 so as to cause the tabs such as 26*a* to protrude outwardly and thus to provide a surface for engaging the tightening edge such as 61*a* of a tightening lug. If the heel portion such as BH of a bottle such as B as shown in FIG. 7 is rounded significantly with a fairly long radius of curvature, it may be difficult to cause the proper manipulation of the lap panels 22 and 23 so as to force the tabs such as 26*a* to project outwardly. Should this situation prevail, a supplementary sword such as is indicated at SS in FIG. 7 may be affixed to each side edge of the sword S. Thus a sharp corner is provided which insures that the tabs 26*a*–31*a* will protrude outwardly as shown in FIG. 7.

INDUSTRIAL APPLICABILITY

This invention is applicable to high speed, high capacity packaging operations and is adapted to minimize down time and package damage.

I claim:

1. Apparatus for tightening a carrier blank about a group of articles, said blank having openings spaced from its end edges and having tabs integral with the end portions of the blank and projecting into said openings, said apparatus comprising means for moving said group of articles along a predetermined path with the blank disposed in overlying relation to the tops and sides of said group of articles and with said openings in the blank disposed adjacent the lower portions of the group of articles, and tightening means movable alongide the group of articles and including a series of tightening lugs having aligned tightening edges arranged to afford a substantially continuous tightening edge which is movable in the general direction of movement of the articles and blank but in a somewhat divergent direction therefrom so as to engage edge portions of said openings and said tabs and the portions of the blank which are intermediate said openings thereby to effect tightening of the blank about the group of articles and to swing the ends thereof underneath the group of articles without imparting drag back force to the blank, and means for moving said lugs and their tightening edges.

2. Apparatus according to claim 1 wherein said lugs on each side of the group of articles are pivotally mounted on an endless element having a working reach movable alongside and generally parallel to the direction of movement of the articles and blank.

3. Apparatus according to claim 2 wherein cam means is fixed in position on said apparatus and disposed to engage parts of said lugs in sequence and thereby to move said parts of said lugs into approximate positions for engaging and tightening the blank.

4. Apparatus according to claim 2 wherein guide means having an inclined portion to guide and move said endless element and to cause a portion of said endless element and certain of said lugs to move downwardly relative to the path of movement of said group of articles and of said blank during a blank tightening operation.

5. Apparatus according to claim 2 wherein each of said lugs comprise a base portion secured to said endless element and a blank engaging portion pivotally mounted on said base portion.

6. Apparatus according to claim 5 wherein said blank engaging portion comprises a single prong having an elongated tightening edge.

7. Apparatus according to claim 5 wherein said blank engaging portion comprises a pair of bifurcated prongs.

8. Apparatus according to claim 7 wherein one of said prongs is disposed generally above the other of said prongs.

9. Apparatus according to claim 8 wherein said one of said prongs projects a greater distance from said base portion than the other of said prongs.

10. Apparatus according to claim 9 wherein said prongs are arranged to receive therebetween the innermost edges of said tabs.

11. A method of tightening a carrier blank about a group of articles said blank having openings spaced from its end edges and having tabs integral with the end portions of the blank and projecting into said openings, the method comprising the steps of moving the group of articles along a predetermined path with the blank disposed in overlying relation to the tops and sides of the group of articles and with the openings in the blank disposed adjacent the lower of the group of articles, imparting an inward and downward substantially frictionless force to said openings and to the parts of the blank adjacent the bottoms of the articles and between said openings on both sides of the blank by engaging the edge portions of said openings and said tabs and the portions of the blank which are intermediate said openings with tightening means having a substantially continuous tightening edge movable with the blank and articles so as to tighten the blank about the group of articles and to swing the ends thereof underneath the group of articles without imparting drag back force to the blank, and moving said tightening means in synchronism with the blank and articles and in the general direction of movement thereof but in a somewhat downward direction.

12. A method according to claim 11 wherein tabs formed integrally with the end portions of the blank extend into said openings and wherein tightening force is imparted to parts of the peripheries of said openings which are disposed on opposite sides of the bases of said tabs.

13. Apparatus for tightening a carrier blank about a group of articles, said blank having openings spaced from its end edges and having tabs integral with the end portions of the blank and projecting into said openings, said apparatus comprising means for moving said group of articles along a predetermined path with the blank disposed in overlying relation to the tops and sides of said group of articles and with said openings in the blank disposed adjacent the lower portions of the group of articles, and tightening means movable alongside the group of articles and including a series of tightening lugs having aligned tightening edges arranged to afford a substantially continuous tightening edge which is movable in the general direction of movement of the articles and blank but in a somewhat downward direction therefrom so as to engage edge portions of said openings and said tabs and the portions of the blank which are intermediate said openings thereby to effect tightening of the blank about the group of articles and to swing the ends thereof underneath the group of articles without imparting drag back force to the blank, means for moving said lugs and their tightening edges, said lugs on each side of the group of articles being pivotally mounted on an endless element having a working reach movable alongside and generally parallel to the direction of movement of the articles and blank, guide means having an inclined portion to guide and move said endless element and to cause a portion thereof and certain of said lugs to move downwardly relative to the path of movement of said group of articles and of said blank during a blank tightening operation and upwardly relative to the path of movement of the group of articles and of said blank following the completion of a blank tightening operation.

* * * * *